US008231095B2

(12) United States Patent
Bean

(10) Patent No.: US 8,231,095 B2
(45) Date of Patent: Jul. 31, 2012

(54) SWINGARM BOW SUPPORT

(75) Inventor: Ron M. Bean, Cedar Rapids, IA (US)

(73) Assignee: Hunter's Specialties, Inc., Cedar Rapids, IA (US)

( * ) Notice: Subject to any disclaimer, the term of this patent is extended or adjusted under 35 U.S.C. 154(b) by 161 days.

(21) Appl. No.: 12/349,188

(22) Filed: Jan. 6, 2009

(65) Prior Publication Data

US 2010/0171008 A1 Jul. 8, 2010

(51) Int. Cl.
*A47H 1/10* (2006.01)

(52) U.S. Cl. ..... 248/323; 248/316.8

(58) Field of Classification Search ..... 248/507, 248/508, 156, 317, 323, 324, 340, 316.8; 124/1, 86; 411/388, 389; 211/60.1, 70, 115, 211/116, 118, 123, 164, 167, 195
See application file for complete search history.

(56) References Cited

U.S. PATENT DOCUMENTS

| | | | | | |
|---|---|---|---|---|---|
| 918,070 | A | * | 4/1909 | Menge | 126/29 |
| 2,678,786 | A | * | 5/1954 | Kindorf | 248/72 |
| 3,062,157 | A | * | 11/1962 | Woods | 410/149 |
| 4,230,296 | A | | 10/1980 | Staley et al. | |
| D260,674 | S | | 9/1981 | Simmons et al. | |
| 4,331,311 | A | | 5/1982 | Russell | |
| 4,377,270 | A | | 3/1983 | Kolongowski | |
| 4,542,873 | A | | 9/1985 | Matherly et al. | |
| 4,730,699 | A | * | 3/1988 | Threlkeld | 182/187 |
| 4,936,415 | A | | 6/1990 | Williams | |
| 5,344,110 | A | | 9/1994 | Scarpa | |
| 5,377,651 | A | | 1/1995 | Sczomak et al. | |
| 5,482,241 | A | | 1/1996 | Oglesby | |
| D371,416 | S | | 7/1996 | Bliss | |
| D375,645 | S | | 11/1996 | Foster et al. | |
| 5,626,322 | A | * | 5/1997 | Braun | 248/282.1 |
| 5,680,939 | A | * | 10/1997 | Oliver | 211/64 |
| 5,711,464 | A | | 1/1998 | Huang | |
| 5,769,372 | A | * | 6/1998 | Klosterman | 248/219.4 |
| 5,775,658 | A | | 7/1998 | Englehardt | |
| 5,819,462 | A | * | 10/1998 | Dockery | 42/94 |
| 5,913,667 | A | * | 6/1999 | Smilee | 42/94 |
| 5,967,475 | A | | 10/1999 | Johnson | |
| 6,012,439 | A | | 1/2000 | Woodruff | |
| D422,333 | S | | 4/2000 | Foster et al. | |
| 6,059,240 | A | | 5/2000 | Gorsuch | |
| 6,062,974 | A | * | 5/2000 | Williams | 452/187 |
| 6,086,026 | A | | 7/2000 | Pearce | |
| 6,244,556 | B1 | | 6/2001 | Carrillo et al. | |
| 6,295,976 | B1 | * | 10/2001 | Runde | 124/86 |
| 6,364,267 | B1 | | 4/2002 | Pearce | |
| 6,478,272 | B1 | * | 11/2002 | McKinsey et al. | 248/216.1 |
| 6,561,477 | B1 | | 5/2003 | Prive | |
| 6,663,059 | B1 | | 12/2003 | Warren | |
| 6,679,465 | B1 | | 1/2004 | Leasure | |
| 6,694,661 | B1 | | 2/2004 | Langford | |
| 6,726,162 | B1 | | 4/2004 | Winter | |
| 6,749,170 | B1 | | 6/2004 | Rhoads | |
| 6,935,065 | B1 | * | 8/2005 | Oliver | 42/94 |
| 6,948,694 | B1 | | 9/2005 | Gilbert | |
| 7,163,183 | B2 | | 1/2007 | Sutherland et al. | |
| 7,314,199 | B1 | | 1/2008 | Ward | |
| 7,341,507 | B1 | * | 3/2008 | Julian, Sr. | 452/192 |
| 2004/0050807 | A1 | * | 3/2004 | Cheng | 211/17 |

* cited by examiner

*Primary Examiner* — A. Joseph Wujciak, III
(74) *Attorney, Agent, or Firm* — McKee, Voorhees & Sease, P.L.C.

(57) ABSTRACT

The disclose describes an improved holder for an archery bow which includes two arms pivotally attached to one another and a sliding support arm for resisting bending moments due to the weight of the bow being held at a distance away from a tree. The support arm and one of the arms each feature a separate fastener for securing the holder to a tree.

12 Claims, 5 Drawing Sheets

SWINGARM BOW SUPPORT

BACKGROUND OF THE INVENTION

This invention generally relates to a device for supporting an archery bow and more particularly to a bow support for supporting a bow in a vertical and easily accessible position near the hunter so that the hunter may quickly access the bow.

While bow hunting, many hunters position themselves where game is likely to pass. While the hunter waits for the game to pass by, it is inconvenient for him to hold an archery bow at the ready. Instead, the hunter may need his hands free in order to perform animal calls or other tasks related to the sport.

Therefore, it is necessary for the hunter to either rest his bow on the ground or on a support. The hunter's bow needs to be easily accessible so that when the game appears, the hunter may quickly retrieve the bow and deliver his arrow to the target.

Other prior art archery bow supports have been described and are used by hunters. One common type of bow support has a threaded end for attaching to a tree and holding the bow at a distance away from the tree.

BRIEF SUMMARY OF THE INVENTION

Often times it is desirable when hunting to have a bow support to hold an archery bow at a distance away from a tree, such as several feet or more. In this case, the weight of the bow on the support creates a moment which may cause the support to pull out of the tree. Therefore, it is preferable to have the support anchored to the tree by a second arm at a point below the anchor point. This arm counters the moment created by the weight of the archery bow on the support.

One problem which has been identified in the art is that often times the tree to which the bow is secured does not have a planar face. Therefore, it may be necessary to anchor the arm at a point away from the face to which the original support is anchored.

It is therefore a primary objective of this invention to provide a support having an arm for holding a bow away from a tree, the support having a separate support arm extending below the arm with the support arm being moveable relative to the tree.

DETAILED DESCRIPTION OF THE PREFERRED EMBODIMENT

Figure 1:
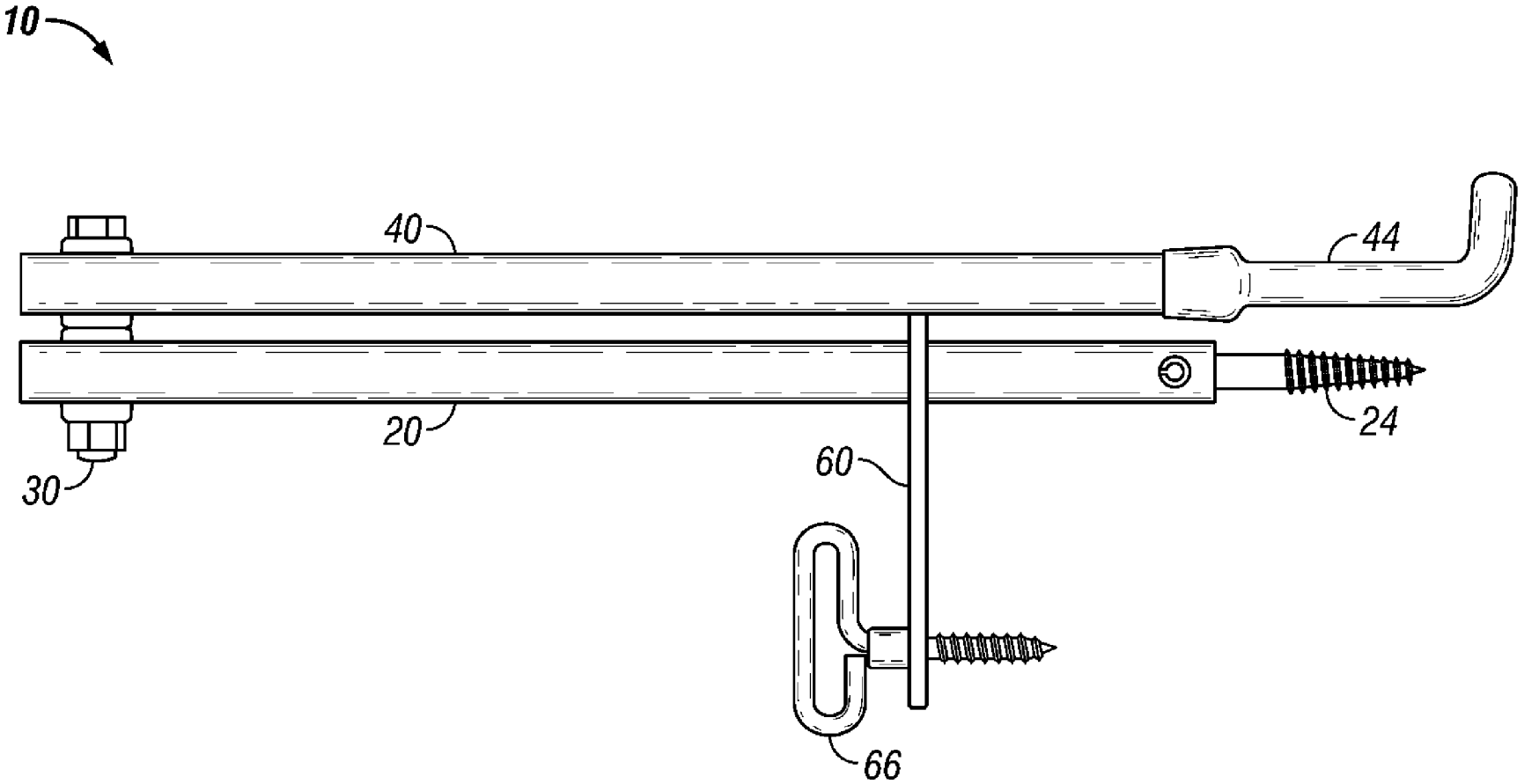
FIG. 1 shows a side view of the preferred bow support in a collapsed position suitable for storage or transport.

The preferred embodiment of the invention in shown in a collapsed position in FIG. 1. The support 10 comprises a first arm 20 and a second arm 40 joined together by a hinge 30. The first arm 20 has a fastener 24 at one end and a support arm 60 positioned between the fastener 24 and hinge 30. The support arm 60 has a second fastener 66 positioned at a distance away from the first arm 20. The support arm 60 is slidable along the first arm 20 between stops 64. The second arm 40 also features a hook 44 positioned at the end opposite the hinge 30.

Figure 2:
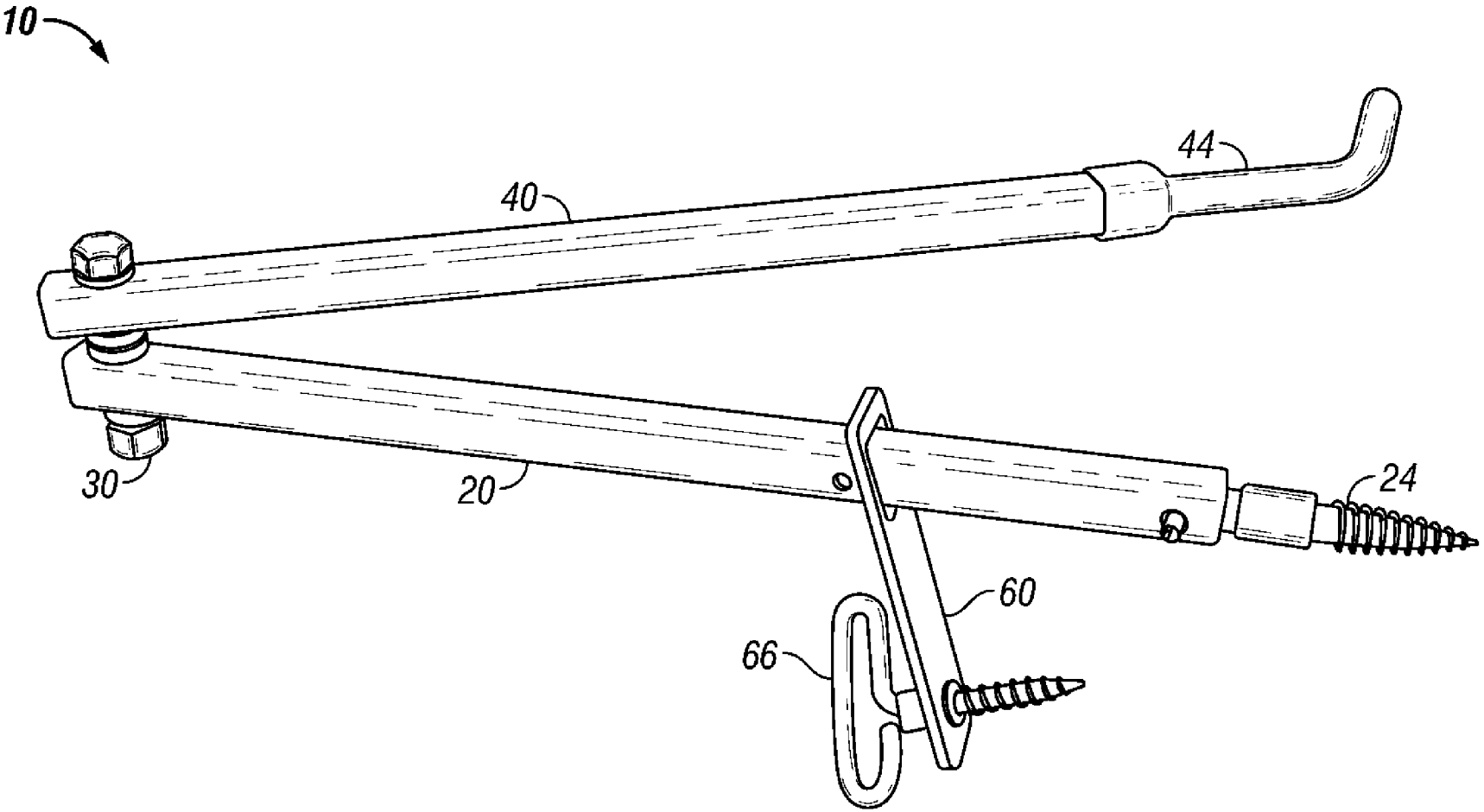
FIG. 2 shows a perspective view of the preferred embodiment in a partially opened position.

FIG. 2 shows a perspective view of the preferred embodiment in a partially opened position. First arm 20 and second arm 40 are shown to pivot about the common axis, hinge 30.

Figure 3:
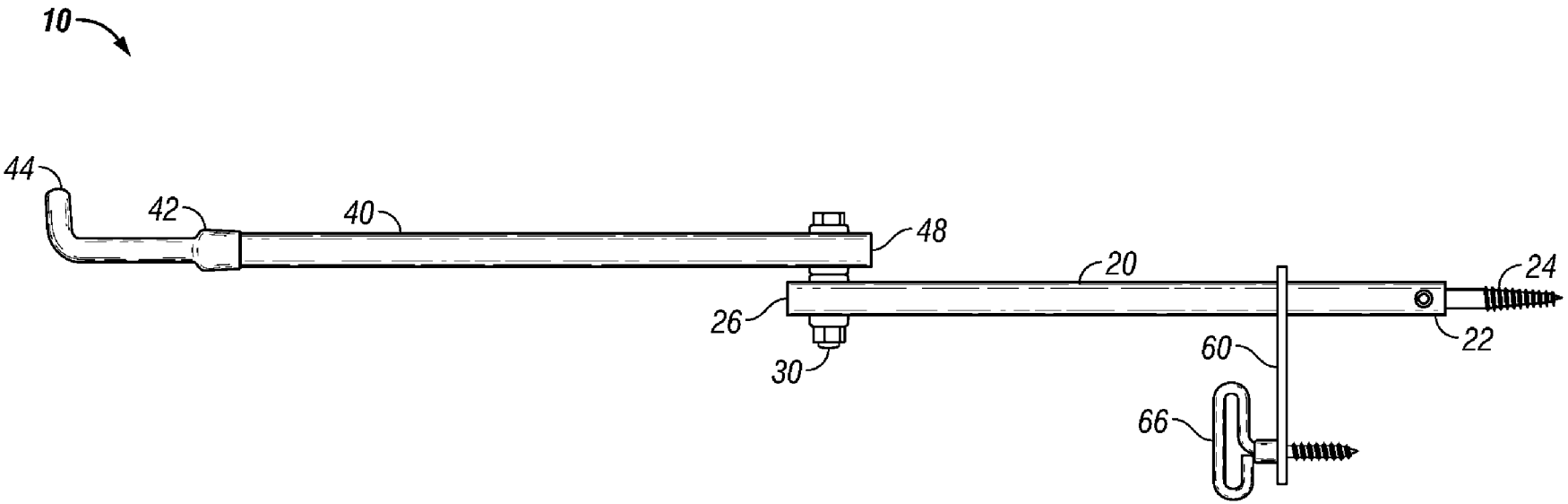
FIG. 3 shows a side view of the preferred embodiment in a fully extended position.

FIG. 3 shows the support 10 fully extended at a side view. As shown, the hook 44 curves upward away from the second arm 40 and the support arm 60 extends downward from the first arm 20. As can be appreciated by those skilled in the art, when the first fastener 24 and second fastener 66 are inserted into a tree, the support arm 60 resists bending forces due to the weight of a bow on the hook 44. The first arm 20 also has a first end 22 corresponding with the fastener 24 and a second end 26 corresponding with the hinge 30. The second arm 40 has a support end 42 corresponding with the hook 44 and an opposite end 48 corresponding with the hinge 30. As previously described, the support arm 60 is slidably attached to the first arm 20 between the first end 24 and second end 26 and features a second fastener 66 at a position away from the first arm 20.

Figure 4:
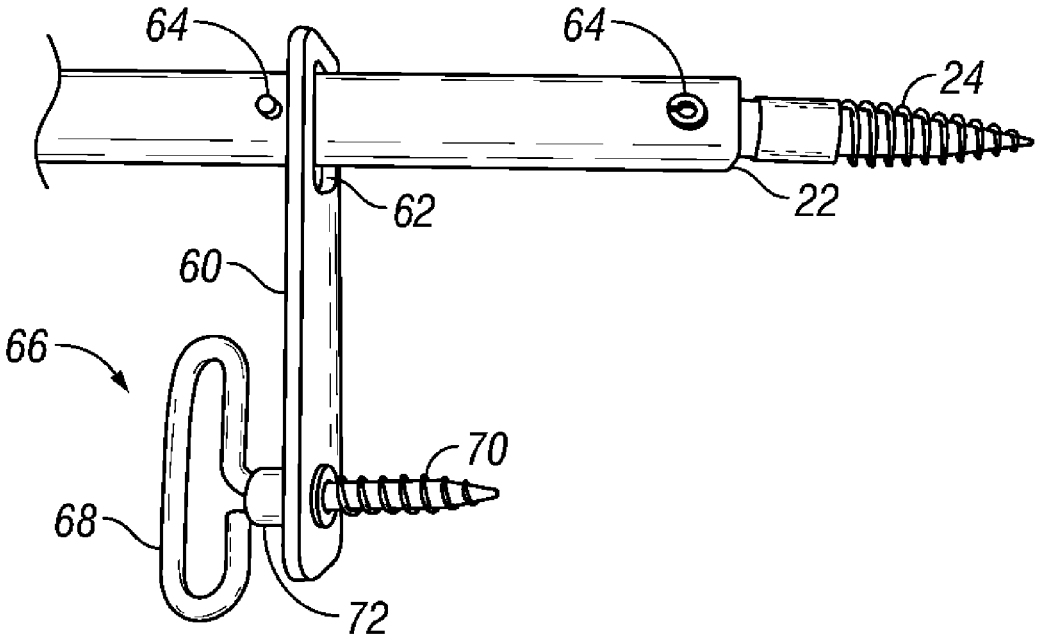
FIG. 4 shows an expanded side view of the support arm and fastener of the preferred bow support.

FIG. 4 shows an expanded view of the support arm 60 and second fastener 66. The first arm 20 has a pair of stops 64 extending from the first end 22 near the fastener 24. The stops 64 limit the travel of the support arm 60. The support arm 60 has a slide hole 62 extending through the arm, the slide hole 62 being sized to fit about the first arm 20. Also on the support arm 60 opposite the slide hole 62 is a second fastener 66. The second fastener 60 generally comprises a thread 70 extending in the same direction as the fastener 24 and a handle 68 for turning the thread 70 into the tree. A metal spacer 72 which limits the depth to which the thread 70 can be inserted into the tree is also provided adjacent the handle 68. When the first arm 20 is fastened to the tree by the fastener 24, the support arm 60 can be positioned so that the thread 70 engages the tree. The user may then turn the handle 68, thereby driving the thread 70 into the tree. This engagement by the support arm 60 into the tree resists bending moments caused by the weight of the bow.

Figure 5:
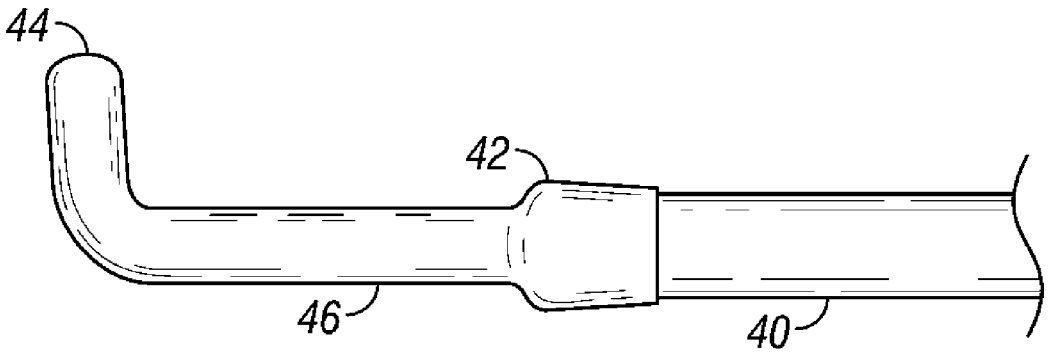
FIG. 5 shows an expanded side view of the hook end of the preferred bow support.

FIG. 5 shows an enlarged view of the support end 42 of the second arm 40. The support end 42 features a hook 44 extending generally upward from the second arm 40. The hook 44 may be covered with a membrane 46 which is preferably of latex or like coating. The membrane 46 provides protection to the bow to eliminate abrasion between the surface of the hook 44 and the bow, as well as providing increased friction so that the bow is less likely to slip off of the hook 44.

Figure 6:
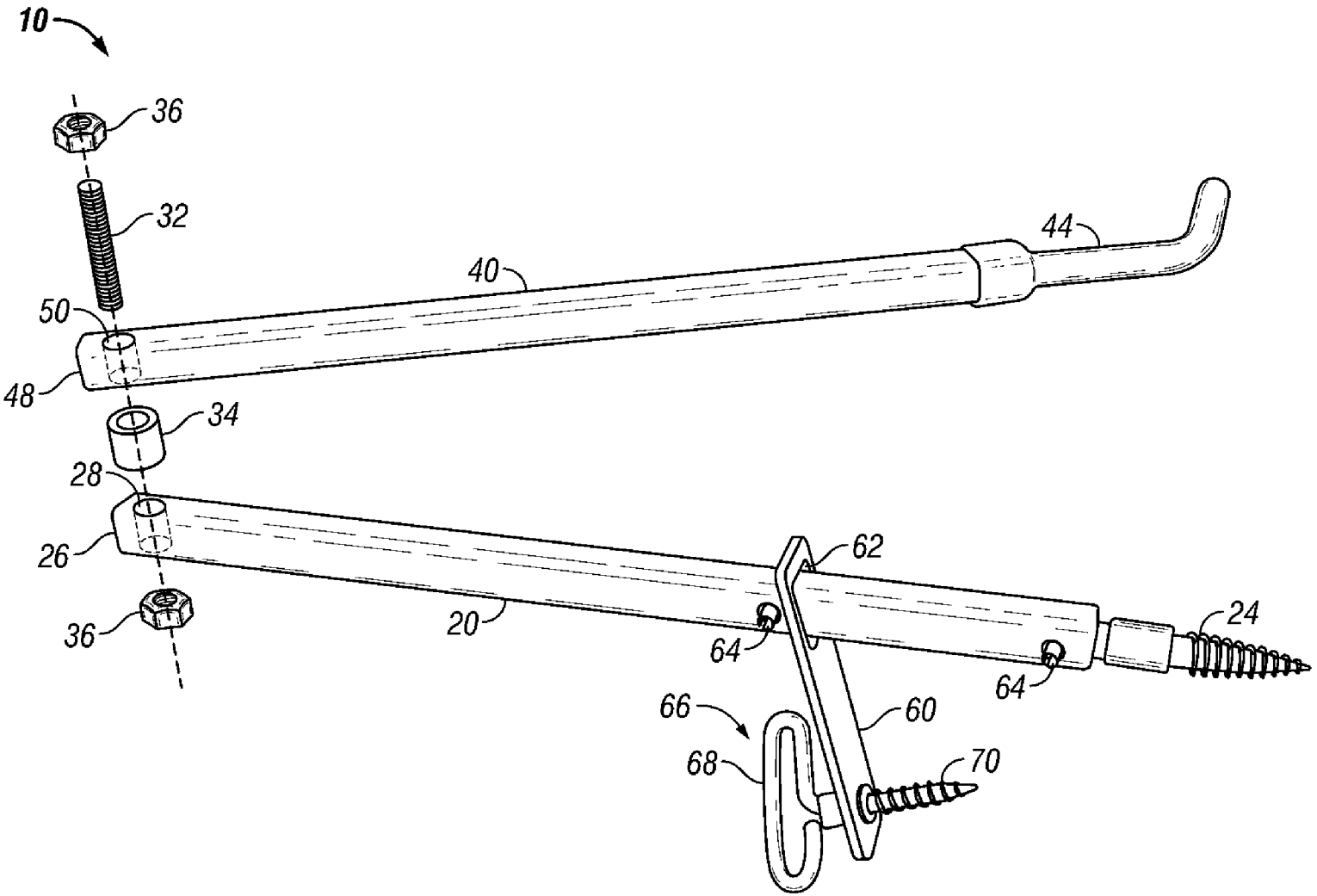
FIG. 6 shows an exploded view of the preferred embodiment of the present invention.

FIG. 6 shows an exploded view of the hinge 30. The hinge is formed from a hinge pin 32 which is held in place by a pair of stops 36. The hinge pin 32 passes through the hinge through hole 50 at the opposite end 48 of the second arm 40. The hinge pin 32 then passes through a spacer 34 which separates the second arm 40 from the first arm 20. The hinge pin 32 finally passes through the hinge pin hole 28 at the second end 26 of the first arm 20 and is secured by a second stop 36. Hinge pin 32 preferably comprises a threaded member such as a screw or threaded rod, while stops 36 comprise either a screw head and nut or a pair of nuts. This type of hinging is merely exemplary in nature and other types of hinges may be used which are generally known in the art.

In use, the hunter first attaches the support 10 to a tree by placing the fastener 24 against the tree and rotating the support 10 until the thread is fully engaged. The hunter then adjusts the support arm 60 along the first arm 20 so that the fastener 66 is engaging the tree at a point below the fastener

24. The hunter then turns the handle 68, driving the threaded end 70 of the fastener 66 into the tree. Once the support 10 is securely fastened to the tree, the hunter rotates the second arm 40 about the hinge 30 to a convenient position. The hunter then may hang his bow onto the hook 44, thereby leaving his hands free for other tasks. When the hunter is ready to use the bow, he may rotate the second arm 40 out of the way.

The above description is of the preferred embodiment of the invention, although other variations are anticipated. For example, the fastener 24 may take other forms different than a threaded screw. One such variation is a belt and buckle assembly may be used for encircling the tree, thereby preventing damage to the tree. Another variation is the fastener 24 including a separate latch for affixing to a screw which may be permanently embedded within the tree. Other attachment variations are generally known in the art. Support arm 60 need not include a fastener 66 for engaging the tree, but may include a cleat or other means for resisting slippage along the tree. The purpose of fastener 66 is to securely position support arm 60 against the tree to oppose the bending moment caused by the weight of the bow. Another variation is providing an adjustable stop 64 to securely position the support arm 60 at a position along the first arm 20. Support arm 60 may also have a means in the slide 62 for fixing the position of the support arm 60.

According to the preferred embodiment, the first arm 20 and the second arm 40 comprise equal lengths of square steel tubing. The square tubing provides high strength and resists bending while remaining durable and light weight. However, other materials, shapes, or lengths may be used.

Other variations of the described invention may be appreciated by those skilled in the art. The above description is exemplary, limitations appear only in the claims.

What is claimed is:

1. A support for holding an archery bow relative a support structure, the support comprising:

a first arm having an elongated body, a first end and a second end, the first end having a fastener extending outwardly from the elongated body;

a second arm having a support end comprising a hook member, an opposite end, and rigidly extending therebetween, the second arm generally parallel to the first arm, and the support end adapted for holding said archery bow and the opposite end hingeably mounted to the second end of the first arm;

a support arm slideably attached to the first arm;

a second fastener on the support arm for connecting the support arm to the support structure; and wherein a first end of the support arm comprises an opening adapted to slide over the first arm.

2. The support of claim 1 wherein the hook member has a membrane for protecting and preventing slippage of the archery bow.

3. The support of claim 2 wherein the hook member and support arm extend in opposing directions.

4. The support of claim 1 wherein the fastener of the first arm is adapted to connect the first arm to a support structure.

5. The support of claim 4 wherein the fastener comprises a threaded screw.

6. The support of claim 5 wherein the second fastener comprises a threaded screw.

7. The support of claim 6 wherein the first arm has at least one stop for limiting the travel of the support arm along the first arm.

8. The support of claim 7 wherein the first and second arms are of substantially equal length.

9. The support of claim 8 wherein the first and second arms comprise tubular members.

10. The support of claim 9 wherein the first and second arms comprise a square cross section.

11. The support of claim 10 wherein the support holds the archery how relative to a tree.

12. An archery bow support comprising:

a first arm having a first end and an opposite second end;

a first screw at the first end of the first arm and being configured to secure the first arm to a tree at a first point;

a second arm having a bow holder and being pivotally mounted for horizontal rotation about the second end of the first arm, the second arm generally parallel to the first arm;

a support arm slidably mounted on the first arm and having a second screw adapted to engage the tree at a second point spaced apart from the first point;

wherein the first end of the support arm comprises an opening adapted to slide over the first arm.

* * * * *

UNITED STATES PATENT AND TRADEMARK OFFICE

CERTIFICATE OF CORRECTION

PATENT NO. : 8,231,095 B2
APPLICATION NO. : 12/349188
DATED : July 31, 2012
INVENTOR(S) : Ron M. Bean It is certified that error appears in the above-identified patent and that said Letters Patent is hereby corrected as shown below:

Column 4, Line 29, Claim 11:
DELETE after archery "how"
ADD after archery --bow--

Signed and Sealed this
Eleventh Day of September, 2012

David J. Kappos

David J. Kappos
*Director of the United States Patent and Trademark Office*